US006121896A

United States Patent [19]

Rahman

[11] Patent Number: 6,121,896

[45] Date of Patent: Sep. 19, 2000

[54] MOTOR VEHICLE EARLY WARNING SYSTEM

[76] Inventor: Anis Rahman, 10 Sequoia Tree La., Irvine, Calif. 92612

[21] Appl. No.: 09/238,014

[22] Filed: Jan. 26, 1999

[51] Int. Cl.[7] ..... G08G 1/00

[52] U.S. Cl. ..... 340/902; 340/903; 340/932; 340/463; 180/167

[58] Field of Search ..... 340/902, 903, 340/904, 905, 438, 439, 932, 463; 180/167, 168, 169, 170, 171, 271

[56] References Cited

U.S. PATENT DOCUMENTS

| | | | |
|---|---|---|---|
| 4,403,208 | 9/1983 | Hodgson et al. | 340/902 |
| 4,706,086 | 11/1987 | Panizza | 340/902 |
| 4,840,243 | 6/1989 | Hirabayashi et al. | 180/140 |
| 5,126,735 | 6/1992 | Trvijano | 340/902 |
| 5,378,888 | 1/1995 | Stappaerts | 250/201.9 |
| 5,424,726 | 6/1995 | Beymer | 340/902 |
| 5,589,827 | 12/1996 | Scurati | 340/901 |
| 5,781,119 | 7/1998 | Yanashita et al. | 340/903 |

*Primary Examiner*—Jeffery A. Hofsass
*Assistant Examiner*—Van T. Trieu
*Attorney, Agent, or Firm*—Richard E. Bee

[57] ABSTRACT

A motor vehicle early warning system is provided for enabling a motor vehicle to receive a warning signal (e. g., a brake activation signal) from a preceding vehicle and automatically and instantaneously transmit a warning signal to a following vehicle independently of any reaction time on the part of the driver of the motor vehicle. A receiver is located at the front of each vehicle for receiving a warning signal from the vehicle ahead of it. A transmitter is located at the rear of each vehicle for transmitting a warning signal to the vehicle behind it. A control unit is located on board each vehicle for responding to the reception of a warning signal by it's receiver for automatically causing it's transmitter to transmit a warning signal to the vehicle behind it.

15 Claims, 3 Drawing Sheets

MOTOR VEHICLE EARLY WARNING SYSTEM

DESCRIPTION

1. Technical Field

This invention relates to motor vehicle collision prevention systems and, particularly, to systems for preventing multi-car pile-ups on highways and freeways.

2. Background of the Invention

Various systems have been proposed for preventing one motor vehicle from colliding with another motor vehicle. Many of these systems employ some form of radar apparatus located on the front end of a motor vehicle for warning the driver of the vehicle when he is approaching another motor vehicle. Most of these systems measure the distance between the two vehicles and some calculate the rate of closure between the two vehicles and sound a warning when a dangerous situation is perceived to exist. Some of these systems provide automatic braking of the radar-equipped vehicle when the closure rate exceeds a safe value for the particular separation distance between the two vehicles.

Another type of system is sometimes referred to as an automated highway system and employs both on-board equipment and roadside infrastructure for automatically causing the vehicles traveling along the highway to maintain a safe speed and following distance. Unfortunately, these systems tend to be somewhat expensive to implement and maintain.

What would be particularly desirable is to provide a relatively simple and inexpensive system for providing a vehicle driver with an early warning of a potentially dangerous situation. Studies have shown that 60% of forward collisions can be avoided with an extra 0.5 second of warning to a vehicle driver. With a full second of extra warning time, the driver can avoid 90% of forward collisions.

SUMMARY OF THE INVENTION

The present invention provides a motor vehicle early warning system wherein a motor vehicle receives a warning signal (e. g., a brake activation signal) from a vehicle ahead of it and automatically and instantaneously transmits a warning signal to a vehicle following behind it within a specified range of distance. This eliminates the driver reaction time for the intervening vehicle and gives the extra warning time needed to avoid a multi-car pile-up.

The present invention enables the first car in a line of cars to automatically and instantaneously communicate with the last car (or any other car) in the line without need for any human reaction or intervention.

To this end, the early warning system of the present invention includes a receiver located at the front of each motor vehicle for receiving a warning signal from the motor vehicle driving in front of it. Each vehicle also includes a transmitter located at the rear of the vehicle for transmitting a warning signal in the rearward direction to the next following vehicle. Each vehicle further includes a control unit which is responsive to the reception of a warning signal by its receiver for causing its transmitter to transmit a warning signal to the car behind it. In this manner, a warning signal is automatically passed from vehicle to vehicle without human intervention.

For a better understanding of the present invention, together with other and further advantages and features thereof, reference is made to the following description taken in connection with the accompanying drawings, the scope of the invention being pointed out in the appended claims.

BRIEF DESCRIPTION OF THE DRAWINGS

Referring to the drawings.

DETAILED DESCRIPTION OF THE ILLUSTRATED EMBODIMENTS

Figure 1:
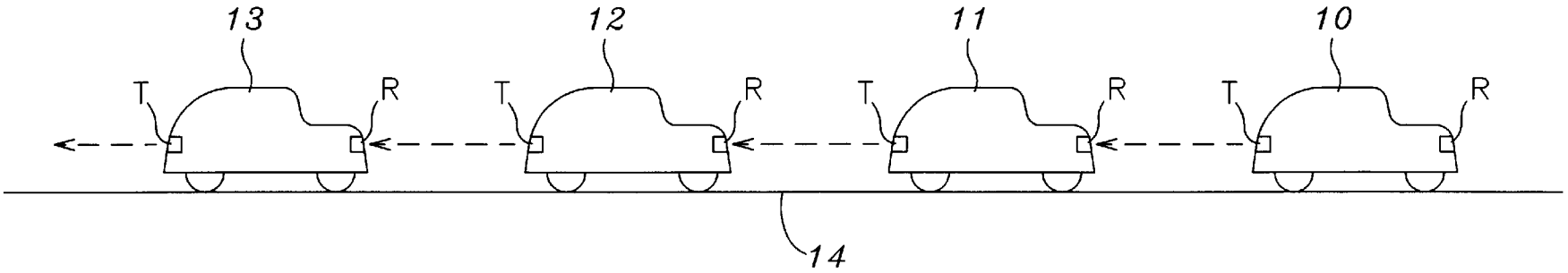
FIG. 1 is an elevational view of a line of motor vehicles moving along a highway from left to right on the page.

Referring to FIG. 1, there is shown line of motor vehicles 10, 11, 12 and 13 moving in a forward direction along a highway 14. Each motor vehicle has a transmitter T located at the rear of the vehicle for transmitting a warning signal in the rearward direction to the vehicle behind it. Each motor vehicle also has a receiver R located at the front of the vehicle for receiving the warning signal transmitted by the vehicle in front of it. Each motor vehicle further has a control unit located on board the vehicle and connected to the receiver R and transmitter T on the vehicle. This control unit is responsive to the reception of a warning signal by its receiver R for causing its transmitter T to transmit a warning signal to the next following vehicle. In this manner, a warning signal is automatically and instantaneously passed from vehicle to vehicle without human intervention.

The warning signal transmitted by each transmitter T is in the form of a narrow highly-focussed beam of radiant energy which is received only by a vehicle in the same traffic lane as the vehicle doing the transmitting. The transmitted signal should not be received by a vehicle in an adjacent traffic lane. The radiant energy may be infrared energy, laser energy or radio frequency energy. Infrared and laser energy are preferred because they are easier to focus into a narrow beam. For sake of simplicity and compatibility, all motor vehicles should transmit radiant energy of the same wavelength.

The event which triggers the initiation of a warning signal may be, for example, the activation of the brakes on one of the motor vehicles. The driver starts to apply the brakes and a warning of this event is immediately passed along from vehicle to vehicle to each of the vehicles following the braking vehicle. As will be seen, this automatically turns on the rear brake lights on each of the following vehicles. So, not only the brake lights on the braking vehicle, but also the brake lights on each following vehicle are automatically and instantaneously turned on. This provides a desired earliest possible warning to the following drivers and should greatly reduce the possibility of a multi-car pile-up.

Figure 2:
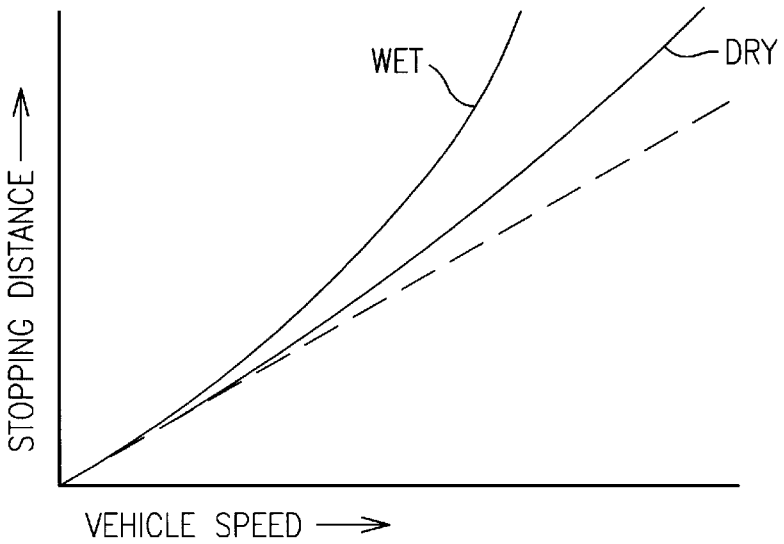
FIG. 2 is a graph describing the relationship between vehicle speed and vehicle stopping distance.

FIG. 2 is a graph describing the relationship between vehicle speed and vehicle stopping distance. The greater the speed of the vehicle, the greater is the distance required to bring it to a complete stop. The relationship is exponential in nature with the stopping distance increasing more rapidly as the speed increases. The condition of the road surface also affects the stopping distance. The stopping distance is greater on a wet road surface, than on a dry road surface.

For these reasons, it is desirable to control the range (distance of transmission) of the transmitted warning signal in accordance with vehicle speed and weather conditions, with a greater range being provided for higher vehicle speeds and poorer road conditions. As will be seen, control of the range is accomplished by controlling the power of the transmitted signal.

Figure 3:
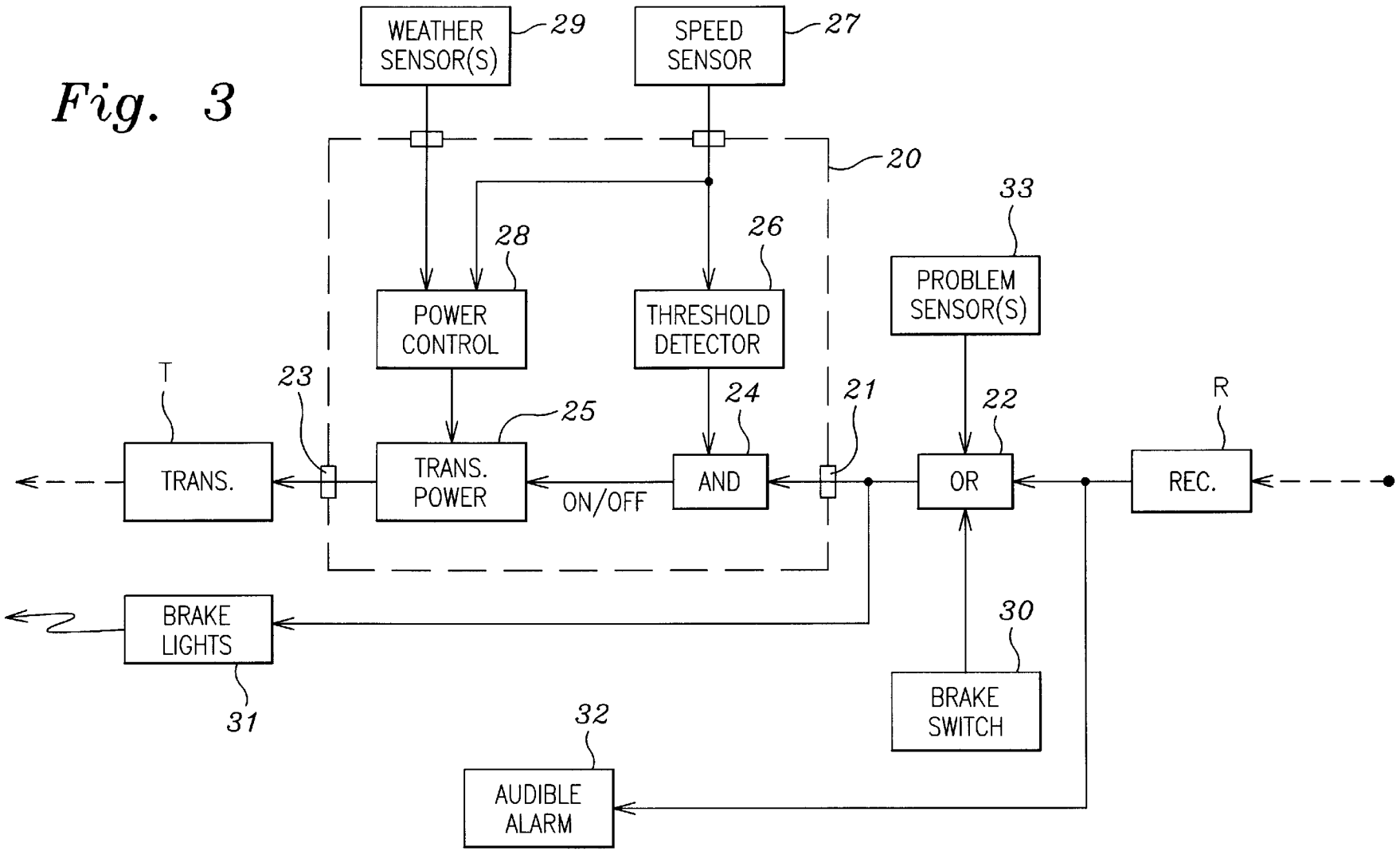
FIG. 3 is a schematic block diagram of the control unit and other apparatus located on board each motor vehicle for a first embodiment of the invention.

Referring to FIG. 3, there is shown a schematic block diagram of the control unit and other pertinent apparatus located on board each one of the motor vehicles 10, 11, 12 and 13 of FIG. 1. The control unit proper is enclosed within a dash-line box and is identified by reference numeral 20. It includes an input connector 21 for receiving a warning signal from the receiver R located at the front of the motor vehicle. Input connector 21 is coupled to receiver R by way of an OR circuit 22. Control unit 20 also includes an output connector 23 for supplying an activation signal to the transmitter T located at the rear of the motor vehicle.

Control unit 20 further includes circuitry coupled between the input and output connectors 21 and 23 for sending an activation signal to the transmitter T when a warning signal is detected by the receiver R. In the illustrated embodiment, this circuitry includes an AND circuit 24 having one input connected to the input connector 21 and having an output connected to a transmitter power circuit 25. Transmitter power circuit 25 supplies operating power to the transmitter T by way of output connector 23. The output signal from AND circuit 24 is an ON/OFF type signal for either enabling or disabling the transmitter power circuit 25.

The control unit 20 also includes a threshold detector circuit 26 for enabling activation of the transmitter T only when the speed of the motor vehicle is greater than a predetermined minimum. The input of threshold detector circuit 26 is connected to a speed sensor 27 which produces a speed signal indicative of the forward speed of the motor vehicle. In most cases, the speed sensor 27 will be the speedometer of the motor vehicle or, in the alternative, a signal-producing circuit which is driven by the vehicle speedometer. The threshold detector 26 compares the speed signal with a pre-set value and, if the speed is greater than the pre-set value, produces as an output an enabling signal which is sent to the second input of AND circuit 24. This enables AND circuit 24 to produce an ON level output signal whenever a warning signal is also being supplied to the input connector 21. Otherwise, the output of AND circuit 24 is at the OFF level.

The purpose of the threshold detector 26 is to disable operation of the transmitter T whenever the motor vehicle is traveling at a relatively slow speed of, for example, less than 25 miles per hour. This is done to prevent activation of the transmitter T when making relatively sharp turns, like around a comer of a city block. When making such sharp turns, the transmitted beam of radiant energy would be momentarily spilling over into adjacent lanes of traffic and this would not be a desirable thing. Since relatively sharp turns are made at lower speeds, the disabling of transmitter T at lower speeds will greatly reduce the likelihood of this happening.

The control unit 20 further includes a power control mechanism 28 for adjusting the power (hence, the range) of the warning signal transmitted by transmitter T in accordance with the speed of the motor vehicle. Power control mechanism 28 receives the speed signal from speed sensor 27 and converts it into an output signal in accordance with the dry road condition speed verses distance curve of FIG. 2. For an analog type speed signal, power control mechanism 28 may take the form of an amplifier circuit having a non-linear signal transfer characteristic corresponding to the "dry" curve of FIG. 2. For the case of a digital type signal, mechanism 28 may take the form of a table look-up device with the speed signal serving to address the look-up table. The power control signal from mechanism 28 is supplied to a control terminal of the transmitter power circuit 25 for adjusting the power supplied to the transmitter T in accordance with the speed of the motor vehicle, with the power increasing as the speed increases.

As an optional feature, the motor vehicle may be provided with a weather sensor 29 for producing an adverse weather signal when an adverse external weather condition or an adverse road surface condition is sensed. This adverse weather signal is supplied as a second input to the power control mechanism 28 for causing such mechanism 28 to operate in accordance with the "wet" curve of FIG. 2. In this manner, the power control mechanism 28 is responsive to both the speed signal and the adverse weather signal for adjusting the power of the transmitted warning signal in accordance with both the vehicle speed and the weather or road surface condition.

The motor vehicle includes as standard equipment a brake activation mechanism or brake switch 30 which is responsive to activation of the brakes of the motor vehicle for producing a brake activation signal. In the conventional case, this brake activation signal would be used to turn on brake lights 31 located at the rear of the motor vehicle. In the present case, this brake activation signal is supplied to another input of OR circuit 22 and the output of OR circuit 22 is supplied to the brake lights 31. Since the warning signal from receiver R is also supplied to the OR circuit 22, this means that brake lights 31 will be turned on by either the brake activation signal from brake switch 30 or the warning signal from receiver R.

By proper adjustment of the brake switch 30, the warning signal can be transmitted to the next vehicle well before the brakes of the braking vehicle are actually engaged. In particular, the brake switch 30 should be set so that only a slight movement of the brake pedal will produce the warning signal, with this occurring before the brakes begin to take hold.

As an optional feature of the present invention, the motor vehicle may be provided with an alarm mechanism which is coupled to the receiver R for producing an alarm when a warning signal is detected by the receiver R. Such an alarm mechanism is represented by audible alarm 32. Such an alarm may, in some cases, get the attention of the driver quicker than his perceiving the turning on of the rear brake lights of the vehicle in front of him.

The motor vehicle may also include a problem sensor mechanism 33 for sensing a vehicle malfunction which is likely to decrease the forward speed of the motor vehicle. When such a malfunction is sensed, problem sensor 33 produces a malfunction signal which is sent by way of OR circuit 22 and AND circuit 24 to the transmitter power supply unit 25 to cause the transmitter T to transmit a warning signal in the rearward direction to the next vehicle in line, provided, of course, that AND circuit 24 is not being disabled by the threshold detector 26. This malfunction signal is also supplied by way of OR circuit 22 to the brake lights 31 for purposes of turning on brake lights 31. Some representative examples of malfunctions which may be sensed are engine failure, brake failure, sudden gear downshifting, and a tire failure (e.g., a blow out).

As seen from the forgoing, the transmitter T transmits a warning signal in the rearward direction whenever the speed of the vehicle is greater than the predetermined threshold value (e.g., 25 miles per hour) and one or more of the receiver R, the brake switch and the problem sensor 33 is outputting a "warning" signal. By way of comparison, the turning on of brake lights 31 is not dependent on the speed of the vehicle. Such brake lights are turned on any time any one or more of receiver R, brake switch 30 or problem sensor 33 produces its "warning" signal.

Figure 4:
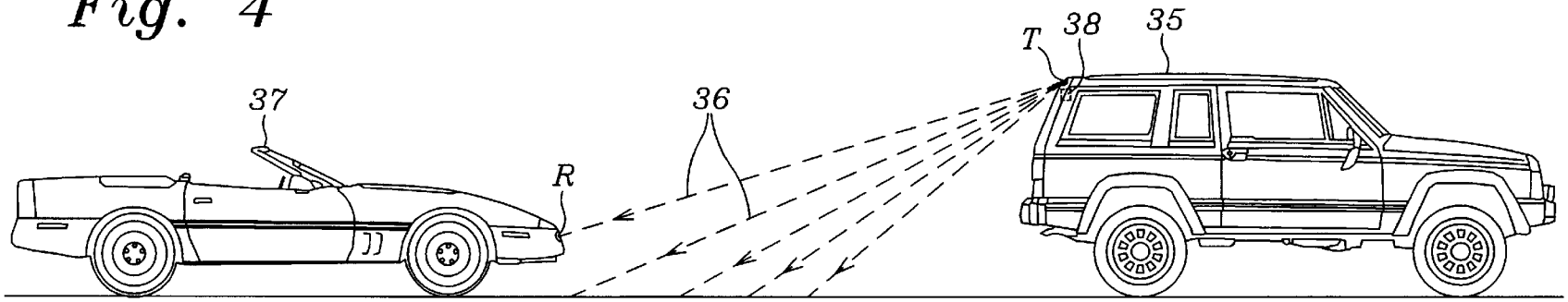
FIG. 4 is an elevational view showing a second embodiment of the invention.

Referring now to FIG. 4, there is shown a modified embodiment of the invention wherein the effective range or transmission distance for the transmitted signal is controlled by adjusting the angle of transmission relative to the road surface. As there seen, a lead vehicle 35 has a transmitter T with the angle of it's transmitted beam being vertically adjustable in an up and down manner as indicated by the different beam positions 36. The angle of the beam determines how close the following vehicle 37 must be before it can detect the beam. This, in turn, determines the "effective" range of the transmitted warning signal.

The vehicle 35 includes a directional mechanism 38 associated with the transmitter T for enabling adjustment of the angle of transmission of the transmitted warning signal relative to the road surface. This mechanism 38 may take the form of a movable mounting structure or platform for holding the transmitter T and capable of tilting the transmitter T at different angles. For the case of a laser beam, the directional mechanism may, instead, take the form of a movable mirror which is mounted so as to enable the laser beam to be deflected at different angles.

Figure 5:
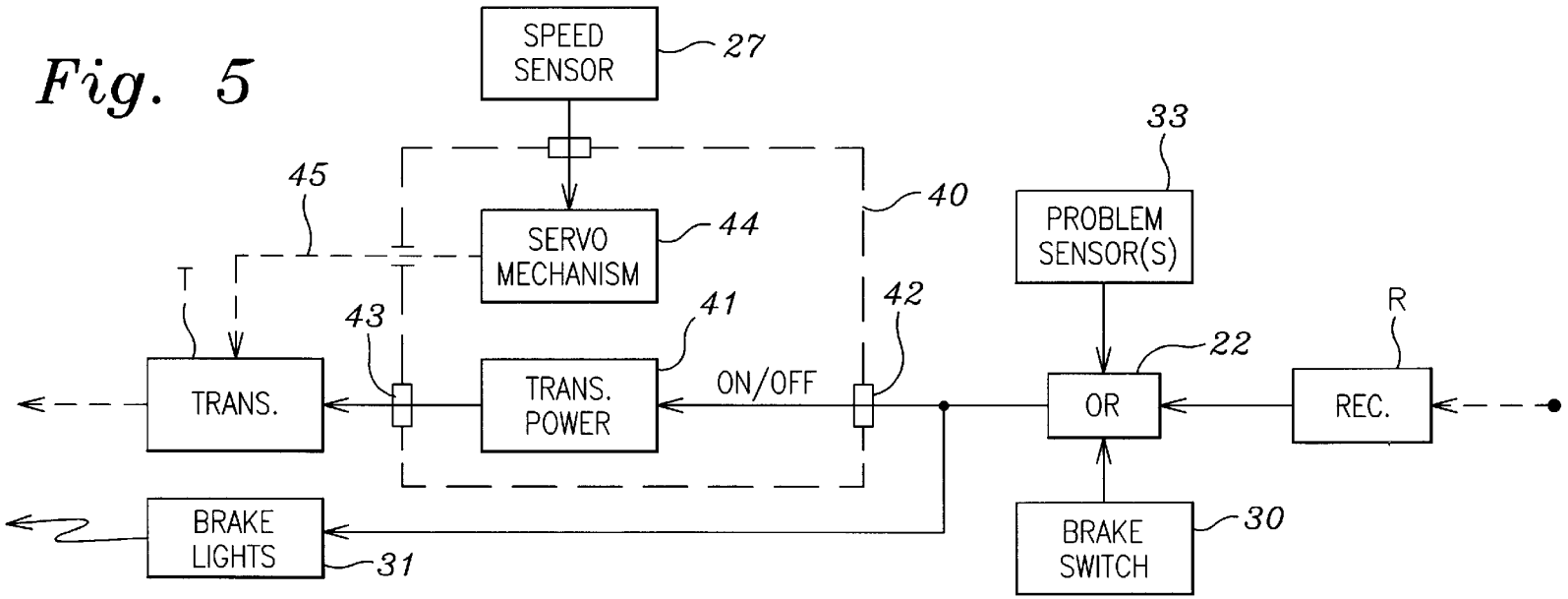
FIG. 5 is a schematic block diagram for the FIG. 4 embodiment.

Referring to FIG. 5, there is shown a schematic block diagram of the control unit and other apparatus for the FIG. 4 embodiment. The same reference numerals are used for the parts which are the same as in the earlier embodiment of FIG. 3. The FIG. 5 embodiment includes a control unit 40 having a transmitter power circuit 41 coupled between an input terminal 42 and an output terminal 43 for supplying operating power to the transmitter T when a warning signal is detected by the receiver R. The control unit 40 also includes a control mechanism represented by a servo mechanism 44 for causing the directional mechanism 38 to adjust the angle of transmission of the warning signal in accordance with the speed of the motor vehicle 35. For this purpose, servo mechanism 44 receives the speed signal from the speed sensor 27. The mechanical linkage from the servo mechanism 44 to the directional mechanism 38 is represented by dash line 45.

Servo mechanism is constructed so that it decreases the angle of transmission as the speed of motor vehicle 35 increases, and vice versa. As the speed gets higher, the beam is raised upwardly so as to approach a more nearly horizontal direction. As the speed decreases, the beam moves in a downwardly direction so as to approach a direction which is more nearly perpendicular to the road surface.

For the control unit 40, there is no threshold detector, so the transmitter is not disabled for slower speeds. Also, the power of the transmitted signal is not adjusted as a function of speed. Instead, the tilting of the beam eliminates the need for these features.

A further embodiment will now be mentioned. In particular, the transmitter T can be constructed so that the transmitted beam is moved in a horizontal direction as the vehicle turns a comer or moves around a curve in the road, the sideward movement being such that the beam remains pointed in the direction of the vehicle behind it. This sideways movement is controlled by a turn sensor coupled to the steering mechanism of the vehicle.

While there have been described what are at present considered to be preferred embodiments of this invention, it will be obvious to those skilled in the art that various changes and modifications may be made therein without departing from the invention and it is, therefore, intended to cover all such changes and modifications as come within the true spirit and scope of the invention.

What is claimed is:

1. A motor vehicle early warning system comprising:

a receiver located at the front of a subject motor vehicle for receiving a warning signal from another motor vehicle driving ahead of the subject motor vehicle;

a transmitter located at the rear of the subject motor vehicle for transmitting a warning signal in a rearward direction;

a control unit located on board the subject motor vehicle and responsive to the reception of a warning signal by the receiver for causing the transmitter to transmit a warning signal in the rearward direction;

and a power control mechanism included in the control unit for adjusting the power of the transmitted warning signal as a function of the speed of the subject motor vehicle.

2. A motor vehicle early warning system in accordance with claim 1 wherein the warning signals are in the form of beams of radiant energy.

3. A motor vehicle early warning system in accordance with claim 2 wherein the radiant energy is infrared energy.

4. A motor vehicle early warning system in accordance with claim 2 wherein the radiant energy is radio frequency energy.

5. A motor vehicle early warning system in accordance with claim 2 wherein the radiant energy is laser energy.

6. A motor vehicle early warning system in accordance with claim 1 wherein the control unit includes a warning mechanism located on board the subject motor vehicle for automatically activating a brake light of the subject motor vehicle without driver intervention when a warning signal is detected/received by the receiver.

7. A motor vehicle early warning system in accordance with claim 1 wherein:

the subject motor vehicle includes a problem sensor for sensing a malfunction which is likely to decrease the forward speed of the subject motor vehicle;

and the control unit is also responsive to detection of a malfunction by the problem sensor for causing the transmitter to transmit a warning signal in the rearward direction.

8. A motor vehicle early warning system in accordance with claim 1 wherein the power of the transmitted warning signal is increased as the speed of the subject motor vehicle increases.

9. A motor vehicle early warning system in accordance with claim wherein the power control mechanism is also responsive to an external weather or road surface condition for adjusting the power of the transmitted warning signal in accordance with both the speed of the subject motor vehicle and the external weather or road surface condition.

10. A motor vehicle early warning system in accordance with claim 1 wherein the control unit includes a threshold detector mechanism for enabling activation of the transmitter only when the speed of the subject motor vehicle is greater than a predetermined minimum.

11. A motor vehicle early warning system in accordance with claim wherein the power control mechanism is also responsive to an external weather or road surface condition for adjusting the power of the transmitted warning signal in accordance with both the speed of the subject motor vehicle and the external weather or road surface condition.

12. A motor vehicle early warning system comprising:

a receiver located at the front of a subject motor vehicle for receiving a warning signal from another motor vehicle driving ahead of the subject motor vehicle;

a transmitter located at the rear of the subject motor vehicle for transmitting a warning signal in a rearward direction;

a control unit located on board the subject motor vehicle and responsive to the reception of a warning signal by the receiver for causing the transmitter to transmit a warning signal in the rearward direction;

a brake activation mechanism responsive to activation of the brakes of the subject motor vehicle for producing a brake activation signal;

a problem sensor mechanism for sensing a malfunction which is likely to decrease the forward speed of the subject motor vehicle and producing a malfunction signal when such a malfunction is sensed;

a speed sensor for producing a speed signal indicative of the forward speed of the subject motor vehicle;

a weather sensor for producing an adverse weather signal when an adverse external weather condition is sensed;

the control unit is responsive to any one or more of the following signals for causing the transmitter to transmit a warning signal in the rearward direction: the warning signal from another motor vehicle the brake activation signal of the subject motor vehicle and the malfunction signal of the subject motor vehicle;

the control unit includes a threshold detector mechanism responsive to the speed signal for enabling activation of the transmitter only when the speed of the subject motor vehicle is greater than a predetermined minimum;

and the control unit includes a power control mechanism responsive to the speed signal and the adverse weather signal for adjusting the power of the transmitted warning signal in accordance with the speed of the subject motor vehicle and the condition of the external weather.

13. A control unit for a vehicle early warning system, such control unit comprising:

an input terminal for receiving a warning signal from a receiver located at the front of a motor vehicle for detecting a warning signal transmitted by another motor vehicle driving ahead of the subject motor vehicle;

an output terminal for supplying an activation signal to a transmitter located at the rear of the motor vehicle for transmitting a warning signal in a rearward direction;

circuitry coupled between the input and output terminals for sending an activation signal to the transmitter when a warning signal is detected by the receiver;

and a power control mechanism for adjusting the power of the transmitted warning signal as a function of the speed of the subject motor vehicle.

14. A control unit in accordance with claim 13 wherein the control unit includes a threshold detector mechanism for enabling activation of the transmitter only when the speed of the motor vehicle is greater than a predetermined minimum.

15. A motor vehicle early warning system comprising:

a receiver located at the front of a subject motor vehicle for receiving a warning signal from another motor vehicle driving ahead of the subject motor vehicle;

a transmitter located at the rear of the subject motor vehicle for transmitting a warning signal in a rearward direction;

a control unit located on board the subject motor vehicle and responsive to the reception of a warning signal by the receiver for causing the transmitter to transmit a warning signal in the rearward direction;

a directional mechanism associated with the transmitter for enabling adjustment of the angle of transmission of the warning signal relative to the road surface;

and the control unit including a control mechanism for causing the directional mechanism to adjust the angle of transmission of the warning signal in accordance with the speed of the subject motor vehicle.

* * * * *